United States Patent [19]

Martin, Jr.

[11] 4,294,502

[45] Oct. 13, 1981

[54] BUSHING TERMINAL AND BUSS BAR

[75] Inventor: Walter L. Martin, Jr., Lexington, N.C.

[73] Assignee: PPG Industries, Inc., Pittsburgh, Pa.

[21] Appl. No.: 72,702

[22] Filed: Sep. 4, 1979

[51] Int. Cl.[3] ..... H01R 13/00

[52] U.S. Cl. ..... 339/112 L; 174/15 C; 174/15 WF

[58] Field of Search ..... 339/112 R, 112 L, 117 R; 174/15 R, 15 C, 15 WF; 219/120; 13/15, 16

[56] References Cited

U.S. PATENT DOCUMENTS

| | | | |
|---|---|---|---|
| 836,155 | 11/1906 | Tone | 13/15 |
| 2,620,373 | 12/1952 | Grayson | 174/15 R |
| 2,671,816 | 3/1954 | Foyn | 13/16 |
| 2,769,964 | 11/1956 | Lartz | 339/230 C |
| 3,294,503 | 12/1966 | Machlan et al. | 65/1 |
| 3,334,170 | 8/1967 | Turner | 339/112 L |
| 4,003,730 | 1/1977 | Brady et al. | 65/1 |

*Primary Examiner*—Neil Abrams

*Attorney, Agent, or Firm*—John E. Curley

[57] ABSTRACT

An electric bushing terminal and buss bar are described which employs fluid cool connectors to a bushing terminal and a transformer terminal which are connected to each other by hollow conductive tubing having some flexibility to thermal and mechanical stress and having a coolant flowing therein. Pressure fits are applied to each connector so that they can be adjusted at the transformer and/or bushing if required.

6 Claims, 12 Drawing Figures

Fig. 1
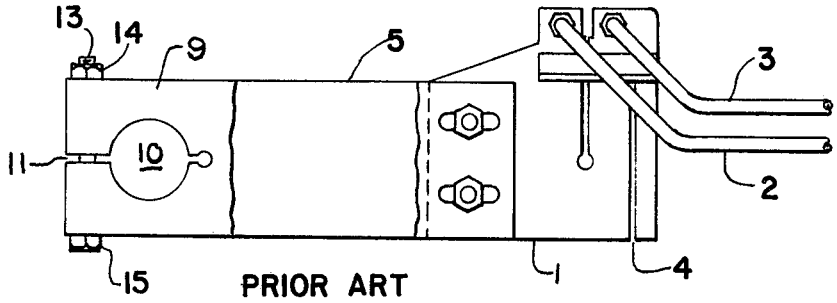
Fig. 2
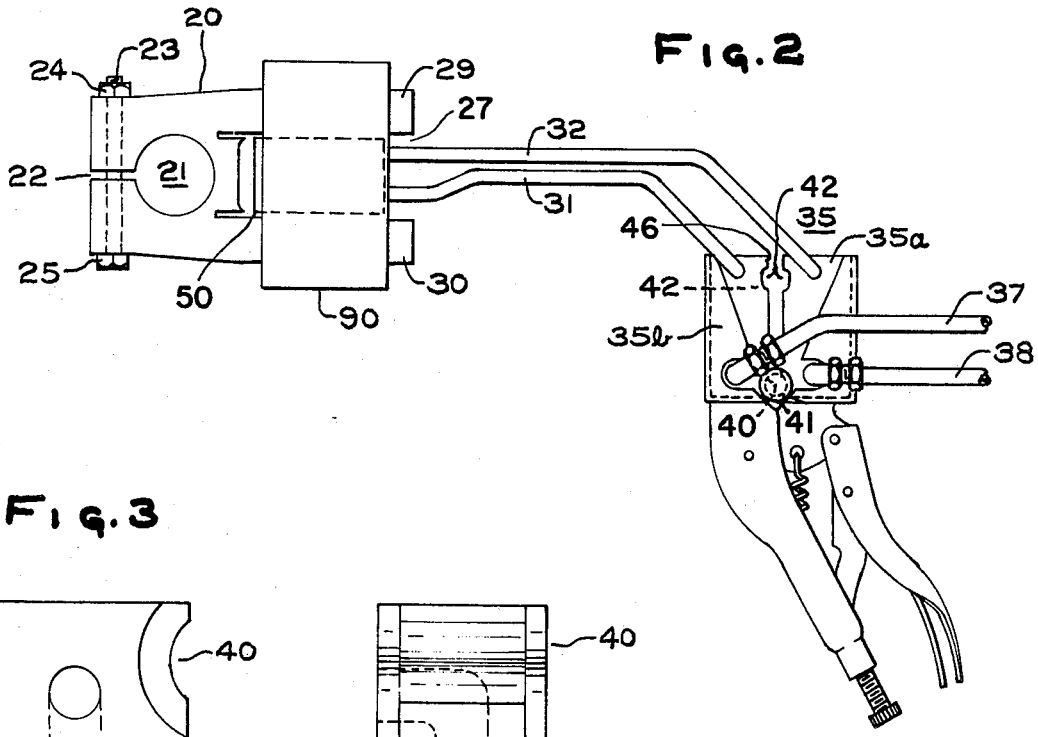
Fig. 3
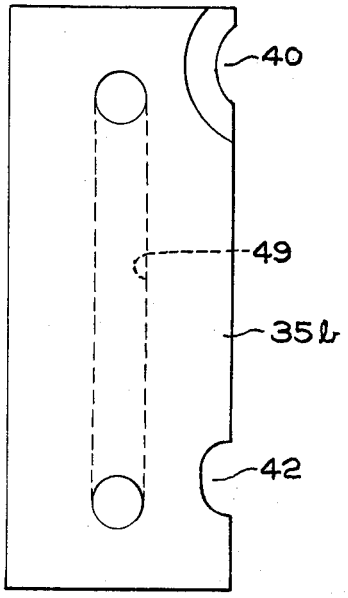
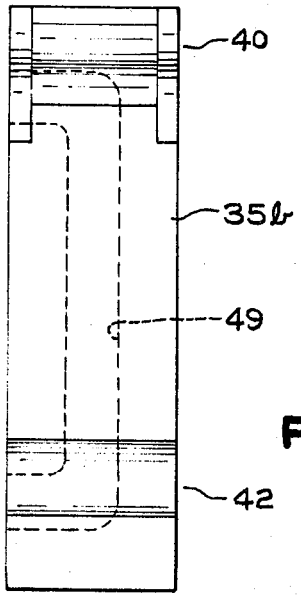
Fig. 4

BUSHING TERMINAL AND BUSS BAR

BACKGROUND OF THE INVENTION

In the manufacture of glass fibers either in a marble melt bushing or by the direct melt process molten glass fibers are drawn from the bottom of a bushing having a plurality of orifices therein. The bushings are constructed of a material resistant to attack by the molten glass contained in them, typically platinum or a platinum-rhodium alloy. In the marble melt bushings glass marbles of suitable composition for the preparation of glass filaments are fed to the upper portion of an electrically heated bushing and the molten glass located in the bottom of the bushing which has been rendered molten by the heating of the glass marbles as they pass through the bushings are drawn through a plurality of orifices or tips located at the bottom of the bushing and collected by winding, chopping or various other secondary procedures. In a direct melt operation, loose glass batch is melted in large quantities in a glass furnace and fed to a forehearth from which a multiplicity of bushings depend and through which the molten glass flows. Thus, the molten glass flows from the furnace through the forehearth and into the bushings. The bushings are again electrically controlled to maintain melting temperatures in the range of 2,000° to 2,400° F. (1090° to 1310° C.) or greater.

In applying and maintaining glass melting temperatures to a bushing proper through electrical heaters provided in the bushing in either of the processes described, considerable stress is placed upon the bushing due to expansion of bushing, the heating elements and the connectors located on the sides of the bushings which deliver current to the bushing. Electrical power is supplied to the bushing normally through two bushing terminals located on either side of the bushing and through two buss bars which are electrically connected to the bushing terminals at one end and connected to the secondary of a power transformer at the other end. Between the connectors to the bushing terminal and the transformer terminal copper buss bars are utilized which normally take the form of braided copper flexible rope or more frequently of flexible copper sheets which are leaved together and mechanically bonded at each end to a connector which is adapted to be connected to the bushing terminal at one end and the transformer secondary at the other end. Flexible copper sheets and flexible braided copper wire are utilized in the application so that thermal stresses and mechanical stresses on the bushing and its connectors can be relieved by the ability of the buss bar itself to flex during operation while the bushing is being heated.

In these prior art buss bar connections, the buss bar utilized to carry currents to the bushing, currents being typically 3,000 to 4,000 amperes at 3 to 7.5 volts, are quite cumbersome and heavy and in a typical bushing can reach weights with their terminal connectors added in of 16 pounds or more. The weight of the buss bar and the terminal connectors utilized to clamp the buss bar to the bushing terminal and the transformer secondary add considerable stress to the bushing. Thus, because of this weight coupled with the thermal expansion of the bushing as it is heated to these elevated temperatures i.e. temperatures of 2,000° F. or above, considerable mechanical stress is placed on the bushing which causes bushing failures in many instances and especially at the terminal connector points on the bushing, generally referred to in the art as the "bushing ears." Further in connecting the buss bars to the bushing terminal and the transformer terminal it is common practice to employ bolts in the bushing terminal area to firmly affix the buss bar to the bushing ear. A typical illustration of the connections of a buss bar to a transformer and to a bushing terminal is shown in FIGS. 3 and 5 of U.S. Pat. No. 4,003,720. Because the connection at the bushing terminal to the buss bar is through a bolted connection, should it be desirable, as it often is in operating the bushing, to move the buss bar closer to the bushing wall or farther away from the bushing wall than its original operating location, all of the bolts must be loosened to move the connector and the buss bar in the desired manner. This is often quite difficult to accomplish because of the atmosphere prevailing around the bushing which causes water and binder deposits on the equipment rendering the loosening of the bolts difficult.

Thus there is a need for providing a bushing terminal and buss bar assembly which is simpler in operation than those presently available in the art, which will render the bushing terminal and buss bar less cumbersome in weight thereby reducing substantially the stresses placed upon the bushing ears to which the bushing terminal and buss bar are connected, and to provide a bushing terminal connection system which will allow for rapid adjustment of the bushing terminal with respect to the bushing heating element with a minimum of time and effort. It is also desirable in constructing bushing terminals and buss bars to eliminate, if possible, the need for the large quantities of electrically conductive material, and copper in particular, currently utilized in the industry to make these connections.

THE PRESENT INVENTION

In accordance with the present invention a bushing terminal and buss bar are provided which are adapted to be connected to a bushing heater element connector and the secondary of a power transformer. The bushing terminal and buss bar are comprised of an electrically conductive block, generally square or rectangular in shape, which is preferably split into two sections. The block itself is provided internally with a passageway on each side of the block for the passage of cooling fluid therethrough and the exit of cooling fluid therefrom. It is provided with a means for introducing fluid into one portion of the block and removing the fluid from a second portion of the block. The block contains two slots generally located intermediate the two sections, one slot being adapted to receive a pin member in a counter sunk hole of precise diameter, a second slot at the other end of the block adapted to engage the terminal of a bushing heater element of a precise thickness. Located on one end of the block, one for each half, are two drilled tapped holes which communicate with the internal passageway of the two halves of the block, and are constructed and arranged to receive a water cooled electrically conductive tubes for insertion therein.

The buss bar is comprised of two elongated hollow, tubular, electrically conductive members adapted to provide for the flow of coolant fluid therethrough. At the opposite end of the tubular devices connected to the two halves of the block forming the bushing terminal connector is a solid block of electrically conductive material tapped and drilled so that coolant fluid can flow in one end of the block and through the other end thus establishing a coolant circulation system between the bushing terminal connector and the solid block. The solid block is constructed and arranged in its geometry and dimensions to be received into a slotted transformer terminal connector. The transformer terminal connector is constructed and arranged at its other end so that it may be connected to the secondary of a power transformer. The transformer terminal connector is a generally U-shaped flat electrically conductive block which is provided with two side walls two side walls of solid electrically conductive material and a back wall which contains in either corner thereof a narrow cut to provide flexibility to the side walls when they are pinched by external forces and moved towards each other. A clamping means is provided on the external surface of the two side walls of the block so that when the solid copper member attached to the hollow buss bar is inserted therein the clamping mechanism can fit around the outside walls of the transformer terminal connector and can be tightened to provide a pressure fit on the solid block inserted between the two side walls of the transformer terminal connector.

A water inlet is provided on one half of the bushing terminal block and a water exit line is provided on the other half so that water introduced into one half of the bushing terminal block will flow through one of the buss bars through the copper block attached to that buss bar and back to the other half of the bushing terminal connector after it is passed through the copper block via the second buss bar.

Means are also provided in association with the bushing terminal connector to bias the ends of the connector towards each other when they are attached to the connector of the bushing heating element (bushing ear) by applying pressure at one end of the assembled block to thereby establish an electrical connection between the power transformer and the bushing heating element.

In assembled form, the hollow tubes utilized to carry water through the bushing terminal connector and the transformer connector assembly, replace the braided copper utilized in the prior art or the interleaved sheets of copper used by the prior art to provide a buss bar connection between a transformer and a bushing while substantially reducing the quantities of copper employed for transferring current from the transformer to the bushing heating element. The assembly of the power transformer connector and tubular buss bar and bushing terminal connector represents a weight reduction over a conventional bushing and transformer connector with an associated flatleaf plate type buss bar of 100 percent or more, thus substantially reducing the stress placed on the terminals of the bushing heating element when the transformer is connected to them through the conventional apparatus. Further the simplified construction of the transformer terminal connector and the bushing terminal connector provide good electrical conductivity between the transformer and the bushing. In addition the construction of the bushing terminal and transformer terminal connectors renders adjustment of their positions with respect to the bushing easy to accomplish with a minimum expenditure of time over devices of the prior art.

BRIEF DESCRIPTION OF THE DRAWINGS

For a more complete understanding of the invention reference is made to the accompanying drawings in which FIG. 1 is a plan view illustration of a terminal connector, buss bar, and transformer connector of conventional design.

FIG. 2 is a plan view of the bushing terminal connector, buss bar and transformer connector of the instant invention.

FIG. 3 is a plan view of one half of the terminal connector of the instant invention showing the internal fluid chambers and the spacer slot.

FIG. 4 is a side elevation of the bushing terminal connector of FIG. 3.

DETAILED DESCRIPTION OF THE DRAWINGS

Figure 5:
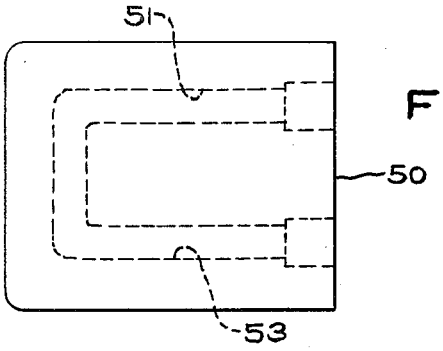
FIG. 5 is a plan view of a portion of the transformer terminal connector of the invention.

In providing a conventional electrical connection of a power transformer to a glass fiber forming bushing a device such as shown in FIG. 1 is employed. As can be readily seen the device is constructed of a bushing terminal connector 1 which is provided with a cooling fluid inlet line 2 and a cooling fluid outlet line 3 to provide cooling to the block or terminal connector 1. A slot 4 is provided to permit attachment of the terminal connector 1 to a bushing terminal or bushing ear so that current can be supplied thereto. The bushing terminal connector 1 is attached at its other end to a plurality of copper sheets 5 through bolts 7 that run through slots 8 and are clamped on the other side with nuts, not shown. The other end of the sheets 5 are embedded in a transformer terminal connector 9 which has an aperture 10 therein which is fitted to a connector, not shown, which is in electrical communication with the secondary of a power transformer. A slot 11 is provided in the transformer connector to permit the transformer terminal connector 9 to be biased firmly around the transformer connector inserted in aperture 10. A bolt 13 connected by nuts 14 and 15 is used to bias the transformer terminal connector 9 tightly on the transformer connector (not shown) which is positioned in aperture 10.

Turning now to FIG. 2, there is shown the novel electrical connection system of the instant invention in assembled form. As shown in that FIGURE the system is provided with a transformer terminal connector 20 which is provided with an aperture 21 and a slot 22. Slot 22, like the device of FIG. 1 can be closed or tightened through bolt 23 and nuts 24 and 25 to close the aperture 21 tightly around a transformer connector when it is placed in aperture 21.

This transformer terminal connector 20 also is provided with two elongated arm like projections 29 and 30 which form a pocket 27 which is adapted to receive a block 50 (not shown) which will be discussed further in connection with FIG. 5. The arms 29 and 30 are also constructed and arranged so that they can be enclosed in a rectangular case 90 provided with clamping means which will be discussed hereinafter in connection with FIGS. 9 and 10. Two cooling fluid lines or tubes 31 and 32 are also shown which are connected to block 50 at one end and terminate at their other ends in a bushing terminal connector generally indicated as 35. The bushing terminal connector 35 is composed of two separate pieces 35*a* and 35*b* which are essentially identical in construction and are designed to be fitted together to form the bushing terminal connector 35. The piece 35*b* is provided with a cooling fluid inlet line 37 and unit 35*a* with a fluid outlet line 38. When the two halves 35*a* and 35*b* are brought together two apertures are formed in the bushing terminal connector 35. One aperture 40 is a counter sunk hole which is designed to receive a pin 41 of precise diameter. The other aperture 42 provides a space in which the bushing ear or terminal can be positioned as the bushing terminal or ear is clamped in the slot 46.

As shown in more detail in FIGS. 3 and 4 unit 35*b* is provided internally with a fluid passage or conduit 49 to permit fluid to flow through the block 35*b* from conduit 37 and to be removed through tube 31. Unit 35*a* is similarly constructed so that fluid passed to it in tube 32 will flow through 35*a* and exit through conduit 38.

Figure 6:
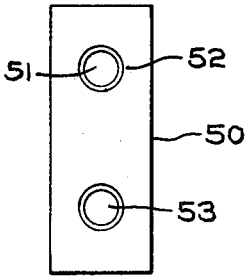
FIG. 6 is a side elevation of the portion of the transformer terminal connector of FIG. 5.

FIGS. 5 and 6 are more detailed drawings of the block 50 which is inside of the housing or casing 90 shown in FIG. 2. As can be seen from the figures, element or block 50 is a solid, electrically conductive member which is provided with an internal conduit or passage 51 which passes through the block 50 in a generally U-shaped path. Fittings 52 and 53 are provided so that fluid conduits 31 and 32 shown in FIG. 2 can be connected to the block 50.

Figure 7:
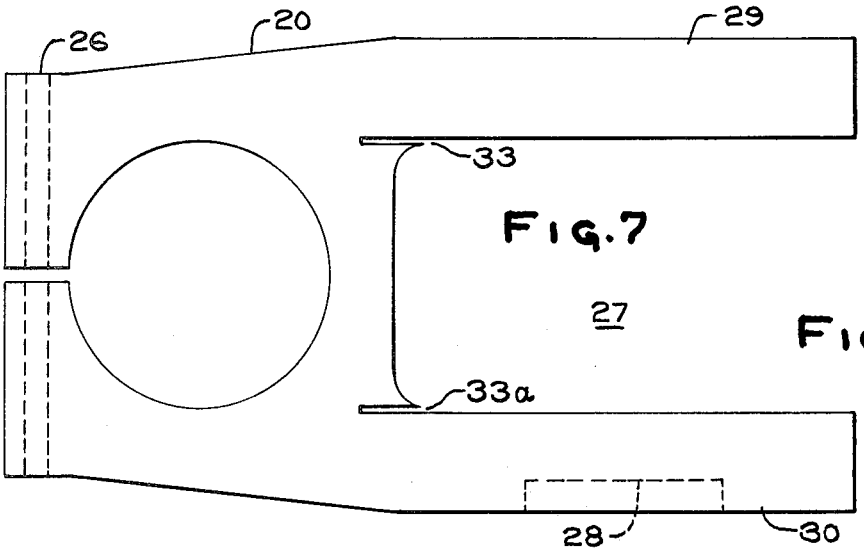
FIG. 7 is a plan view of another part of the transformer terminal connector of the invention.
Figure 8:
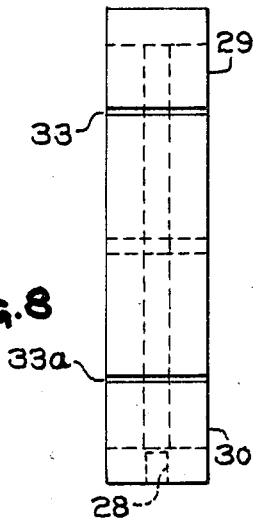
FIG. 8 is a side elevation of FIG. 7.

Turning to FIGS. 7 and 8, the transformer terminal connector 20 is shown in more detail. The transformer terminal connector 20 and the two arms 29 and 30 form a recess 27 in the transformer terminal connector 20 into which the block 50 may be inserted. Arm 30 is provided on its lateral wall with an elongated slot or recess 28 which will be explained more fully hereinafter in connection with element 90. Two slots 33 and 33*a* are provided in each corner of the back wall of the recess 27 formed by arms 29 and 30 so that arms 29 and 30 can be moved inwardly toward each other when pressure is applied to their outside walls.

Figure 9:
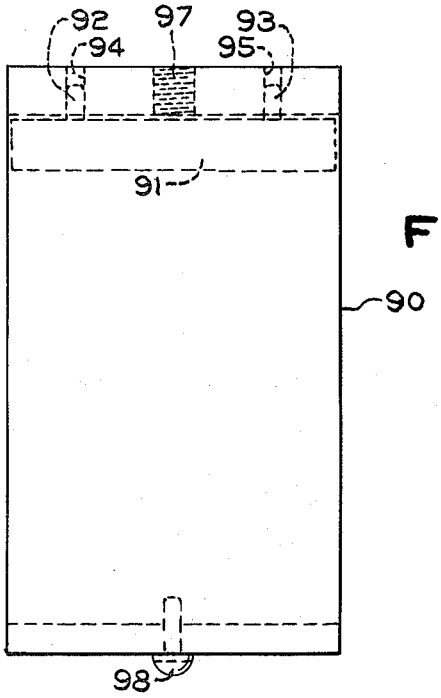
FIG. 9 is a plan view partially in section of a clamping means for the transformer terminal connector of FIGS. 5 and 7.
Figure 10:
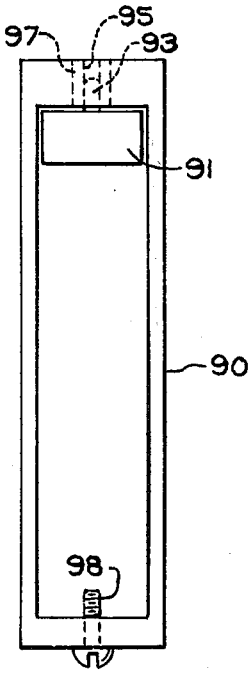
FIG. 10 is a side elevation of the clamping means of FIG. 9.

In FIGS. 9 and 10 the housing 90 is shown. As can be appreciated from the drawing a plate member 91 is positioned inside the housing 90 on one of the walls and is held in place by two stable pin members 92 and 93 affixed to the plate 91 and mounted in holes 94 and 95. Set screw 97 is provided in a tapped hole which permits the screw to be biased against the plate 91 when it is moved inwardly and which moves plate 91 outwardly when the screw is rotated to move it outwardly. On the other lateral wall of the housing 90 is a screw type pin member 98 which is adapted to slide in the groove 28 of arm 30 of the transformer terminal connector 20 when housing 90 is in the position shown in FIG. 2 to permit forward and backward movement of element 90 without detachment from arms 29 and 30.

Figure 11:
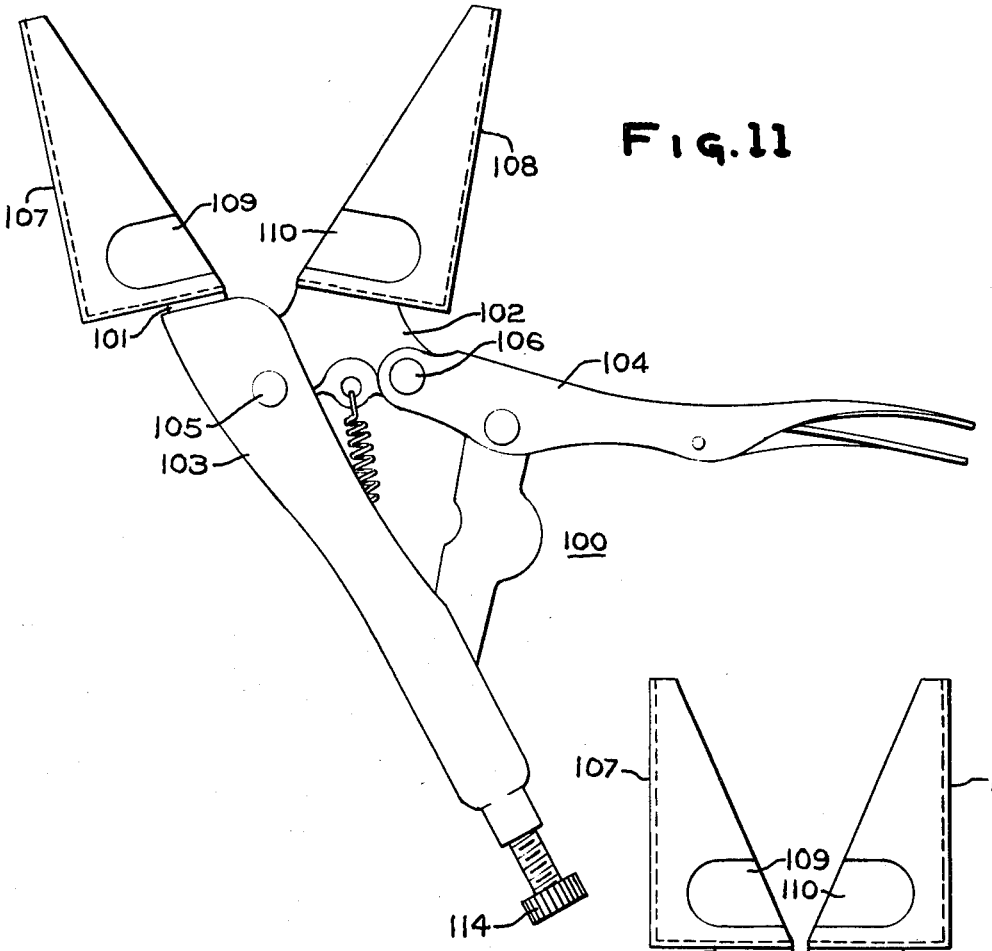
FIG. 11 is a clamping means for the bushing terminal connector of FIGS. 3 and 4 in an open position.
Figure 12:
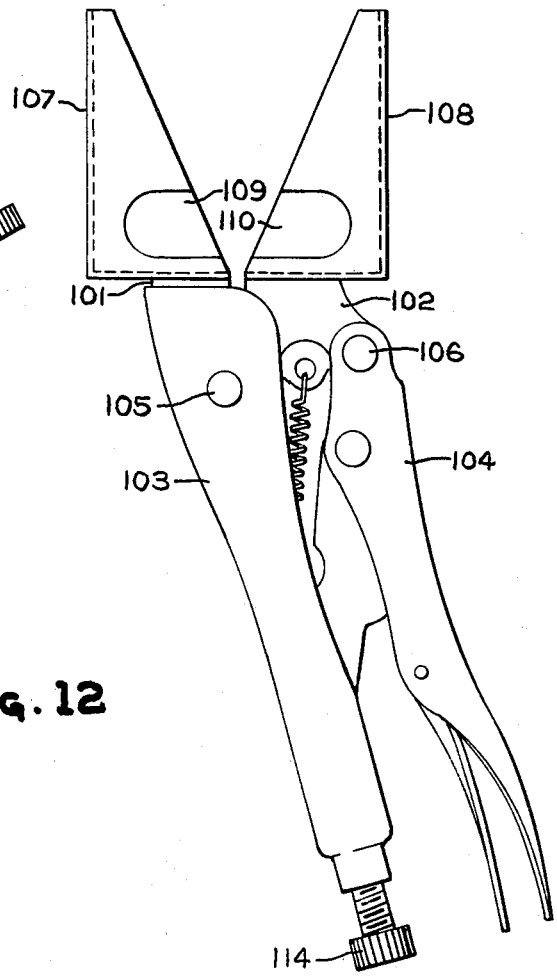
FIG. 12 is the clamping means of FIG. 11 in a closed position.

FIGS. 11 and 12 show the clamping device used to connect the bushing terminal clamp 35 to a bushing terminal. The device is constructed of a conventional vice grip 100 which has affixed to it plates 101 and 102 which are attached to handles 103 and 104 with rivets 105 and 106 and have two triangular shaped receptacles 107 and 108 affixed to the upper surface of plates 101 and 102 respectively which are adapted to receive pin 41 of the bushing terminal connector 35. The receptacles 107 and 108 are provided with slots 109 and 110 respectively. The receptacles 107 and 108 are precisely sized so that each will hold one half of the bushing terminal connector 35. Thus, 35*b* is carried in receptacle 107 and 35*a* is carried in receptacle 108. The pin 41 is located in hole 40 of bushing terminal connector 35°. In the receptacles 107 and 108 are slots 109 and 110 which fit around water lines 31 and 32 when the clamping device 100 is moved to the closed position shown in FIG. 2. Adjustment of the extent to which receptacles 107 and 108 are drawn together are made using the screw 114 located in handle 103 in a manner well known to those skilled in the art.

In operation, the bushing terminal connector 35 is attached to a bushing ear and terminal by inserting the ear in slot 46. If the bushing ear is $\frac{3}{8}$ of an inch in thickness a pin 41 having a $\frac{3}{8}$ of an inch diameter is placed in hole 40 and the two halves of the terminal connector 35*a* and 35*b* are placed in the clamp 103 in each of the halves 107 and 108 respectively with the pin 41 riding in a shoulder provided in hole 40. The clamp 103 is closed to bring the ends of 35*a* and 35*b* to a parallel position as shown in FIG. 2 to thereby firmly grip the bushing ear in slot 46. The transformer connector is inserted in aperture 21 of the transformer terminal connector 20 and is firmly attached by biasing the end of the transformer terminal connector to the transformer connector using bolt 23 and nuts 24 and 25. Case or housing 90 is placed in position over the arms 29 and 30 and block 50 is inserted therein. The screw 97 is moved inwardly to move plate 91 against the outside wall of arm 29 and bias arms 29 and 30 against the block 50 to form a tight pressure fit. Cooling fluid, preferably water, is circulated from line 37 into unit 35*b* through line 31 and block 50 via passage 51 into line 32. The water is then passed through block 35*a* to outlet line 37. Operating in this fashion good electrical conductivity is achieved between the transformer and the bushing with a minimum of stress being placed on the bushing connector and adequate cooling of the connector 35 is also achieved.

In general the bus bars 31 and 32 are constructed of copper tubing typically having a $\frac{1}{8}''$ wall thickness and a $\frac{3}{8}''$ external diameter. If desired, of course, larger or smaller diameter tubes may be used to convey the fluid cooling medium. The connectors 35 and 20 are also preferably constructed of copper although the use of other electrically conductive metals are within the contemplation of the invention.

The pin 41 is an adjustment element to accomodate the slot 46 to the thickness of the bushing terminal and thus is of variable diameter. In general if the bushing ear is $\frac{1}{8}''$ in diameter, for example, the pin diameter is $\frac{1}{8}''$. If the ear is $\frac{3}{8}''$ in diameter the pin diameter is $\frac{3}{8}''$ and so on.

In actual operation on a fiber forming bushing the device of FIG. 2 was installed and supplied current to the bushing to maintain bushing temperature in the range of 2000° to 2200° F. for a period of 131 days. The bushing operated without incident and the electrical supply and equipment functioned similar to the flat plate buss bar connection previously employed.

While the invention has been described with reference to certain specific embodiments and illustrations it is not intended to be limited thereby except insofar as appears in the accompanying claims.

What is claimed is:

1. An electrically conductive supply connector suitable for use in connecting a power transformer to a fiber glass forming bushing comprising a bushing terminal connector having an electrically conductive body provided with a slot adapted to receive the electrical supply terminal of a fiber glass bushing, means to circulate cooling fluid through said body, means to connect at least two tubular bus bars to said body, a metal block on the opposite the ends of said bus bars provided internally with a cooling fluid passage and in communication with the bus bars so that fluid can be circulated from said body through one of said bus bars and said block and back to said body, a transformer terminal connector having a solid electrically conductive core provided with two arm like extensions forming a recess therein and adapted to receive said body, means to clamp said body in said recess and form an electrical connection between said extension and said body and means in said core to connect said core to the secondary of a power transformer.

2. The apparatus of claim 1 wherein slots are provided in each corner of said recess to permit said arm-like extensions to be moved toward each other when pressure is applied to their outside surfaces.

3. An electrical supply system for connecting a fiber glass bushing to a power transformer comprising an electrically conductive bushing terminal connector having a means at one end for connecting it to an electrical terminal, means at the opposite end to adjust the width of the connecting means; means to flow cooling fluid through said bushing terminal connector to control the temperature thereof, buss means electrically connected to said bushing terminal connector, said buss means comprising two hollow tubes which are adapted to receive cooling fluid from said bushing terminal connector and to return cooling fluid to said bushing terminal connector, an electrically conductive block connected to said hollow tubes at their end position, said block having a cooling fluid path provided internally therein to permit fluid to flow from one of said tubes through the block and into the second hollow tube, an electrically conductive transformer terminal connector constructed and arranged to permit said block to be inserted therein at one end thereof and having two sides surrounding said block when the block is inserted therein, means to bias said sides against said block to establish a pressure fit between said block and said transformer terminal connector and means to electrically connect said transformer terminal connector to the secondary of a power transformer.

4. A transformer terminal connector comprising an electrically conductive block of metal, means at one end of said block to connect said block to a transformer terminal, a generally u-shaped recess in said block formed by two elongated arm-like extensions thereof, said recess being adapted to receive a solid, electrically conductive member therein, clamping means to bias the arm-like projections inwardly toward each other to provide a connection between the transformer terminal connector and a solid electrically conductive member inserted in said recess, slot means provided on the outside surface of one of said arm-like projections, an adjustable pin member provided through one side wall of said clamping means and terminating in said slot, said slot being arranged to prevent said clamping member from sliding off of said arm-like extensions when the pin member is inserted in said slot.

5. The apparatus of claim 4 wherein slots are provided in said block in each corner at the base of said arm like extension to permit the said extentions to be moved toward each other when pressure is applied to their outside surfaces.

6. A clamping means for use in connecting a bushing terminal to a bushing terminal connector comprising a vice grip, two generally triangular cups affixed to the jaws of said grip, each of said cups being constructed and arranged to receive a solid electrically conductive block therein, slot means in one side wall at the base of each cup having a generally u-shaped configuration to provide access to the electrically conductive blocks contained in said cups, means to move said cup toward each other when the vice grip is in a closed position to move electrically conductive blocks contained in each cup towards each other to provide clamping pressure on any connector positioned between the cups, and means to move said cups away from each other to disconnect the conductive blocks contained thereon from any connector they are clamped to.

* * * * *

UNITED STATES PATENT AND TRADEMARK OFFICE

CERTIFICATE OF CORRECTION

PATENT NO. : 4,294,502

DATED : October 13, 1981

INVENTOR(S) : W. L. Martin, Jr.

It is certified that error appears in the above-identified patent and that said Letters Patent are hereby corrected as shown below:

On the cover page in the title cancel "BUSS BAR" and substitute -BUS BAR-;

On the cover page in the first line of the abstract, cancel "buss" and substitute -bus-;

In each of the following locations cancel "buss" and substitute -bus-:

Column 1, lines 38, 42, 52, 54 (two occurrences), 59, and 60;

Column 2, lines 2, 4, 6, 9, 11, 14, 20, 22, 25, 30, 38, 41 and 60;

Column 3, lines 16, 26 (two occurrences), 29, 42, 47 and 50;

Column 4, lines 2 and 5;

Column 6, line 64;

Column 7, lines 33 and 34.

Signed and Sealed this

*Twenty-third* Day of *March 1982*

|SEAL|

*Attest:*

GERALD J. MOSSINGHOFF

*Attesting Officer*

*Commissioner of Patents and Trademarks*